US007487554B1

(12) United States Patent
Epstein et al.

(10) Patent No.: US 7,487,554 B1
(45) Date of Patent: Feb. 10, 2009

(54) GARMENT BORNE DISPENSER FOR VOLATILE INSECT REPELLING MATERIALS

(76) Inventors: Ellen Epstein, 1238 Wrightstown Rd., Newtown, PA (US) 18940; Susan Epstein, 1238 Wrightstown Rd., Newtown, PA (US) 18940

( * ) Notice: Subject to any disclaimer, the term of this patent is extended or adjusted under 35 U.S.C. 154(b) by 413 days.

(21) Appl. No.: 11/267,545

(22) Filed: Nov. 7, 2005

(51) Int. Cl.
*A41D 19/00* (2006.01)

(52) U.S. Cl. ..... 2/209.13; 2/171.2

(58) Field of Classification Search ..... 2/171.2, 2/174, 175.3, 181, 182.3, 181.6, 209.13, 2/209.3
See application file for complete search history.

(56) References Cited

U.S. PATENT DOCUMENTS 1,133,542 A * 3/1915 Deal ..... 43/57.1
1,780,408 A * 11/1930 Smith ..... 239/36
4,047,505 A 9/1977 McAndless ..... 119/106
4,744,514 A * 5/1988 Gadoua ..... 239/36
5,003,635 A 4/1991 Peterson ..... 2/69
D363,111 S 10/1995 Walburn et al. ..... D22/122
5,656,282 A * 8/1997 Cook et al. ..... 424/409
6,936,269 B2 * 8/2005 Robinson ..... 424/409
2004/0255363 A1 * 12/2004 Gabriel ..... 2/171.2
2006/0198245 A1 * 9/2006 Cheung ..... 367/139
2007/0228184 A1 * 10/2007 Chen ..... 239/36

* cited by examiner

*Primary Examiner*—Katherine Moran
(74) *Attorney, Agent, or Firm*—LaMorte & Associates, P.C.

(57) ABSTRACT

A system and method of dispensing volatile material near the edge of a garment, such as a hat or shirt. A dispensing element is provided that contains volatile material and slowly releases the volatile material into a surrounding environment. The dispensing element is thin and unobtrusive. The dispensing element is affixed to the edge of a garment, preferably along a hemline or collar. These are the areas on a person wear there is typically exposed skin. The dispensing element dispenses the volatile material into the environment surrounding the edge of the garment. This protects areas of exposed skin without having to treat the skin or garments directly. Furthermore, the dispensing element itself appears to be part of the structure of the garment and therefore is not unsightly.

9 Claims, 5 Drawing Sheets

GARMENT BORNE DISPENSER FOR VOLATILE INSECT REPELLING MATERIALS

BACKGROUND OF THE INVENTION

1. Field of the Invention

In general, the present invention relates to devices that retain a volume of insect repellant and expose that material to the surrounding environment. The present invention also relates to accessories that attach to garments, especially hats.

2. Prior Art Description

There are many compounds, both in nature and manmade, that repel certain insects. In order for any insect repellant to be effective in keeping insects away from a person, a person must apply the insect repellant to either his/her skin or clothing. When a person is outdoors in an insect infested area, it is typically the uncovered areas of the skin that get bitten the most. Even some insects that do not bite are drawn to unprotected skin. For example, many species of gnats and flies tend to swarm around the head of a person, often landing near a person's eyes, nose and mouth.

In order to be effective, the volatiles of an insect repellant must be in strong concentrations around the area of the person needing protection. It is for this reason that insect repellant is often applied directly to areas of exposed skin, especially on the legs, arms and neck. However, many insect repellents contain chemical compounds, such as DEET, that are highly toxic. Other insect repellants, such as citronella oil, are less toxic, but have strong aromas that get absorbed into the skin and clothing upon which it is applied. People are therefore presented with a choice between getting bitten by insects, smelling like bug spray, or having chemicals on their skin and clothing.

In an attempt to avoid the problem of applying insect repellant directly to the skin or to a garment, disposable articles have been invented that are presaturated with insect repellant. The disposable items are then carried by a person traveling outdoors into an insect infested area. Some such articles are specifically designed for pets and come in the form of pet collars. Other items have adhesive backings and can be applied to any object. Pet collars that are saturated with insect repellants are exemplified by U.S. Pat. No. 4,047,505 to McAndless, entitled Insect Repellant Collar. Insect repellants with adhesive backings are exemplified by U.S. Pat. No. D363,111 to Walburn, entitled Multi-Purpose Self-Adhesive Insect and Parasite repellant.

In U.S. Statutory Invention Registration H1731 to Ahr, entitled Insect Repellant Article, a disposable object is shown that contains a breakable packet of insect repellant. Once the breakable packet is opened, insect repellant soaks the absorbent material of the article. The article therefore repels insects until the insect repellent evaporates.

A problem with secondary objects, such as those disclosed in the Walburm patent and the Ahr registration is that they are unsightly if worn directly upon the clothing. However, these objects must be worn directly on the clothing in order to be effective. Another disadvantage of such prior art articles is that the insect repellant fades rapidly. After one day's use, such prior art articles fail to be effective.

Of course, insect repellant articles can be hidden within the structure of a garment. For example, in U.S. Pat. No. 5,003,635 to Peterson, entitled Clothing Including Insect Repellant Strips, clothing is shown having insect repellant strips used as drawstrings. The strips are mostly encased within the sewn hems of the garment. Accordingly, only a small portion of the insect repellant article is exposed to the surrounding environment. Such insect repellant articles therefore might be effective against ticks that crawl on the skin, but have little or no effect on flying insects such as mosquitoes and gnats.

A need therefore exists for an insect repellant article that does not contaminate a person's skin or clothing, yet is effective against flying insects and is not highly visible. This need is met by the present invention as described and claimed below.

SUMMARY OF THE INVENTION

The present invention is a system and method of dispensing volatile material near the edge of a garment, such as a hat or shirt. A dispensing element is provided that contains volatile material and slowly releases the volatile material into a surrounding environment. The dispensing element is thin and unobtrusive. The dispensing element is affixed to the edge of a garment, preferably along a hemline or collar. These are the areas on a person wear there is typically exposed skin. The dispensing element dispenses the volatile material into the environment surrounding the edge of the garment. This protects areas of exposed skin without having to treat the skin or garments directly. Furthermore, the dispensing element itself appears to be part of the structure of the garment and therefore is not unsightly.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention dispensing system can be used to dispense many types of volatile materials, such as perfumes, pheromones, masking scents for hunting and the like, the present invention is especially well suited for use in dispensing insect repelling materials. Accordingly, the present invention will be described as being used to dispense insect repelling materials in order to set forth the best mode contemplated for the invention.

Figure 1:
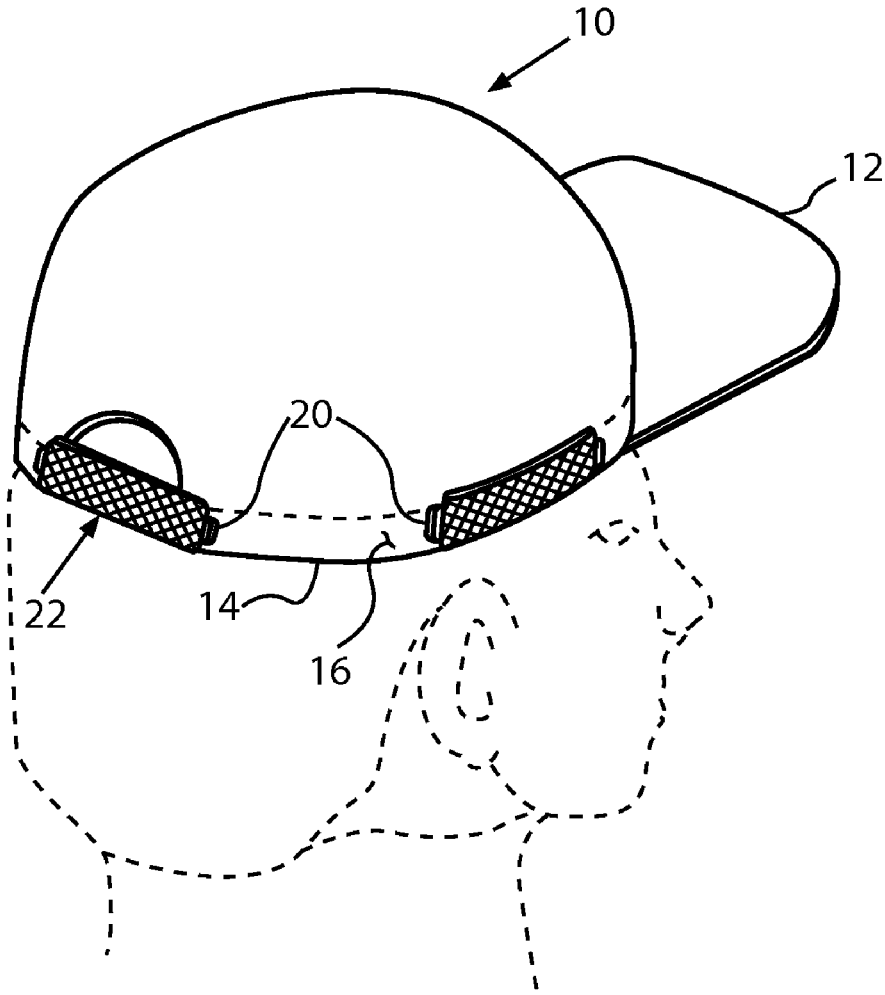
FIG. 1 is a perspective view of a hat assembly containing the present invention dispensing system.
Figure 2:
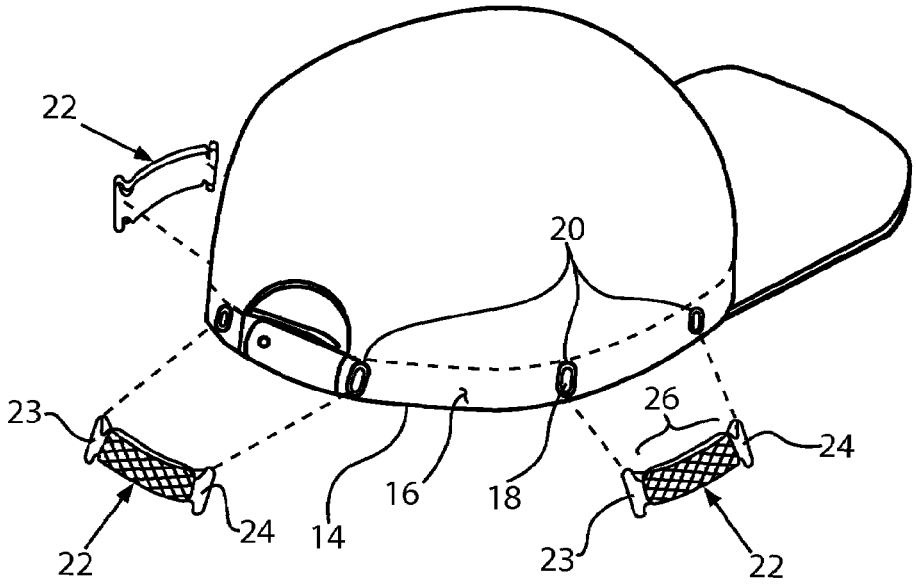
FIG. 2 is an exploded view of the exemplary embodiment of FIG. 1.

Referring to both FIG. 1, and FIG. 2, a hat 10 is shown. The hat 10 has been modified to accept the present invention dispensing system. The hat 10 being illustrated is a baseball hat, having a forward facing brim 12. The hat 10 has an open bottom edge 14, which is the widest part of the hat 10 that passes around a person's head. A headband 16 is formed around the periphery of the hat 10 just adjacent to the bottom edge 14. The headband 16 is configured as a folded seam that is sewn closed. Accordingly, the folded seam of the headband 16 defines an enclosed interior area 18. Slits 20 are formed in the headband 16. The slits 20 are arranged in matched pairs. The slits 20 do not pass completely through the structure of the hat 10. Rather, the slits 20 are cut only in the outermost layer of fabric and provide access to the enclosed interior area 18 of the headband 16. The edges of each slit 20 are sewn to prevent unraveling of the fabric along the slit 20. Accordingly, each of the slits 20 has the same general construction as a buttonhole.

In the shown embodiment, there are two sets of slits 20 formed in the headband 16. In each set of the slits 20, the slits 20 are positioned between one and four inches apart along the headband 16. The number of slits 20 shown is exemplary. It should therefore be understood that any number of slits 20 can be utilized. The only limitation on the number of slits 20 is the space available along the circumference of the headband 16.

A dispensing element 22 is provided for each pair of slits 20 present on the hat 10. Each dispensing element 22 contains a volume of a volatile liquid, such as insect repellant, that evaporates into the surrounding environment. The dispensing element 22 enables the volatile liquid to evaporate in a controlled manner, thereby dispensing the volatile liquid into the space surrounding the dispensing element 22. Since each dispensing element 22 is worn along the headband 16 of a hat 10, the volatile liquid is dispensed around the head of a person wearing the hat 10. The volatile liquid is therefore in high concentrations near the neck and face of the person wearing the hat. If the volatile liquid is an insect repellant, such an area of distribution is particularly effective in keeping mosquitoes and gnats away from the neck and face.

Each dispensing element 22 has two opposing ends 23, 24. The ends 23, 24 of the dispensing element 22 pass into the slits 20 in the headband 16 of the hat 10. The dispensing elements 22 have a generally planar configuration and are no wider than the headband 16 itself. Accordingly, when attached to a hat 16, they appear to be parts of the structure of the hat's headband 16. The presence of the dispensing elements 22 is therefore camouflaged into the structure of the hat 10 and does not detract from the aesthetics of the hat 10.

From the embodiment of FIG. 1 and FIG. 2, it can be seen that the ends 23, 24 of the dispensing element 22 are wider than the central section 26 of that same dispensing element 22. The ends 23, 24 are larger than the slits 20 and can only be passed into the slits 20 by an angled manipulation. Once the ends 23, 24 of the dispensing element 22 are passed into a pair of slits 20, the wide ends 23, 24 of the dispensing element 22 prevent the dispensing element 22 from inadvertently falling out of the slits 20.

Figure 3:
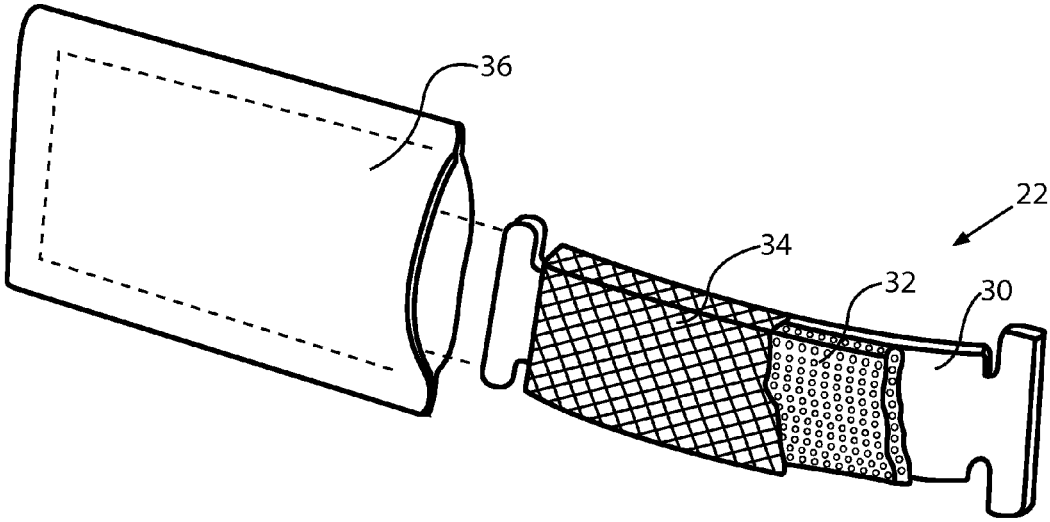
FIG. 3 is a selectively cross-sectioned view of the structure of an exemplary embodiment of a dispensing element.

Referring to FIG. 3, it can be seen that each dispensing element 22 has a composite structure. A flexible substrate 30 is provided. The flexible substrate 30 is preferably a thin strip of plastic or another material that is impervious to the volatile liquids being used. In this manner, the presence of the substrates 30 acts as a protective barrier to the volatile material that prevents its seepage in one direction. The substrate 30 therefore prevents the volatile material from seeping inwardly and contaminating the material of the hat 10 and eventually the hair of the person wearing the hat 10.

An absorbent layer 32 is present above the substrate 30. The absorbent layer 32 can be cork material, sponge material, paper pulp material or any other material that is flexible, yet can retain a significant volume of volatile liquid.

A protective layer 34 is disposed over the absorbent layer 32. The protective layer 34 is perforated, or otherwise highly air permeable. However, the protective layer 34 is made of material that is impermeable to the volatile liquids being used. The protective layer 34 therefore does not absorb the volatile liquids present in the absorbent layer 32.

The protective layer 34 serves two purposes. First, the protective layer 34 controls the amount of air that is exposed to the absorbent layer 32. The protective layer 34, therefore, prevents the absorbent layer 32 from drying out too rapidly. This enables the absorbent layer 32 to dispense the volatile liquid over a prolonged period of time. Second, the protective later 34 prevents direct contact with the absorbent layer 32. The absorbent layer 32, therefore, does not collect dust or otherwise collect contaminants that may prevent the volatile liquid from evaporating.

The dispensing elements 22 are removable from the hat 10. As volatile liquid evaporates from the dispensing elements 22, the dispensing elements 22 will eventually dry up. To prevent the dispensing elements 22 from drying, they may initially come packaged in an airtight bag or similar packaging 36. The packaging 36 can be torn and the dispensing elements 22 removed when new dispensing elements are needed.

Figure 4:
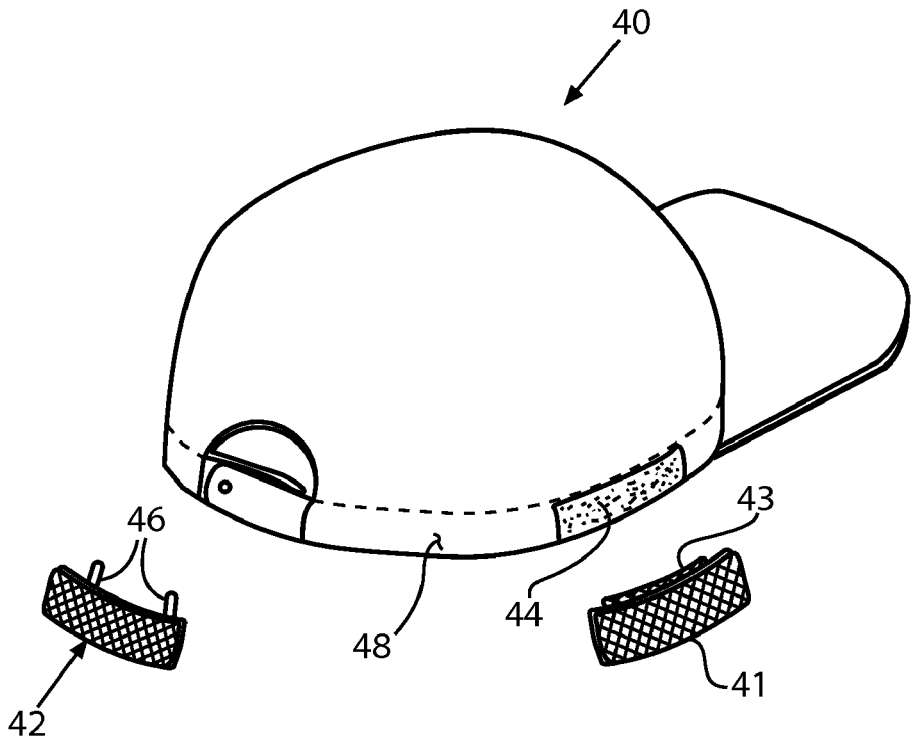
FIG. 4 is a perspective view of alternate embodiments of dispensing elements shown in conjunction with a hat.

Referring to FIG. 4, an embodiment of a hat 40 is shown that embodies alternate attachment schemes for dispensing elements 41, 42. In FIG. 4, a dispensing element 41 is shown that has an area of hook and loop material 43, such as Velcro® on its bottom. The hook and loop material 43 attaches to a corresponding area of hook and loop material 44 on the exterior surface of the hat 40.

A dispensing element 42 is also shown with clips 46. The clips 46 extend from the back of the dispensing element 42 and selectively attach the dispensing element 42 to the headband 48 of the hat 40.

In all of the embodiments of the present invention thus described, a dispensing element has been attached to the headband of a hat. However, using the various attachment schemes that have been described, it will be understood that a dispensing element can also be attached to different garments, such as shirts.

Figure 5:
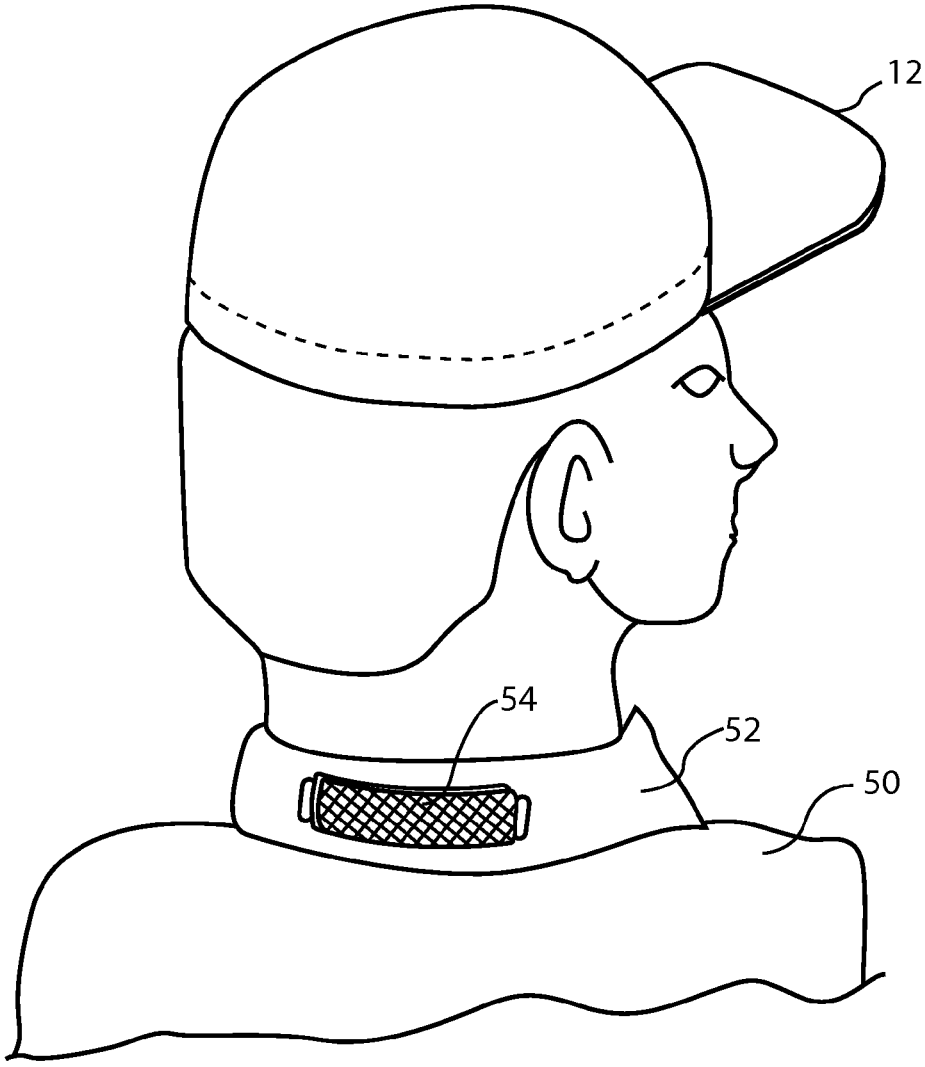
FIG. 5 is a perspective view of a dispensing element being attached to a shirt collar.

Referring to FIG. 5, a section of a shirt 50 is shown. The shirt 50 has a collar 52. A dispensing element 54 is attached to the collar 52. The dispensing element 54 can be attached using the buttonhole technique of FIG. 1 or the mechanical fastener techniques shown in FIG. 4. The collar 52 of the shirt 50 creates a folded hem and therefore has a structure very similar to that of a hat headband. Furthermore, a shirt collar 52 is equally close to the neck and face as is a hat. Therefore the presence of the dispensing element 54 on the collar 52 is just as effective in protecting the head and neck as would be attaching the dispensing element 54 to a hat.

It will be understood that if a person wants volatile material in the air proximate the head, the dispensing device is best attached to a hat or to a collar. However, if a person wants protection near their legs and ankles, a different point of attachment is needed. Using the attachment techniques previously described, a dispensing element can be attached to a shoe, a sock or the hem of a pair of shorts. In such a position, the dispensing element would be better positioned to offer protection to a person's legs.

It will be understood that the embodiments of the present invention described and illustrated are merely exemplary and that a person skilled in the art can make many variations to those embodiments using functionally equivalent components. For instance, the hook and loop material in FIG. 5 can be replaced with other mechanical fasteners, such as snaps. Similarly, there exist many types of clips other than the single design shown in FIG. 5. It should also be understood that the shape of the actual dispensing element is a matter of design choice and need not be limited to the rectangular shape shown. All such variations, modifications and alternate embodiments are intended to be included within the scope of the present invention as defined by the claims.

What is claimed is:

1. A hat assembly comprising:

a hat having an exterior surface, a bottom edge and a folded hem at said bottom edge that defines a headband with an enclosed interior area;

a plurality of slits formed in said headband that provide access to said enclosed interior area;

a dispensing element that contains a volume of volatile material, said dispensing element having a first end and a second end, wherein said first end passes into a first of said plurality of slits and said second end passes into a second of said plurality of slits therein suspending said dispensing element between said first slit and said second slit on said exterior surface of said hat.

2. The assembly according to claim 1, wherein said first end and said second end are larger than any of said slits formed in said headband and only pass into said slits with an angled manipulation.

3. The assembly according to claim, 1, wherein said at least one dispensing element includes a substrate, a layer of absorbent material covering at least a portion of said substrate and a protective layer covering said layer of absorbent material.

4. The assembly according to claim 3, wherein said layer of absorbent material can absorb a volume of said volatile material, said substrate is impermeable to said volatile material and said protective layer is porous.

5. The assembly according to claim 1, wherein said volatile material includes insect repellant.

6. A method of dispensing volatile material near a hem of a garment, said method comprising the steps of:

providing a first slit and a second slit in said hem; and providing a dispensing element that contains said volatile material and slowly releases said volatile material into a surrounding environment, said dispensing element having a first end and a second end, wherein said first end passes into said first slit and said second end passes into said second slit, therein suspending said dispensing element along said hem between said first slit and said second slit;

wherein said dispensing element dispenses said volatile material into the environment around a person's body not directly covered by said garment.

7. The method according to claim 6, wherein said garment is a hat and said edge of said garment is a headband of said hat.

8. The method according to claim 6, wherein said garment is a shirt and said edge of said garment is a collar of said shirt.

9. The method according to claim 6, wherein said step of providing a dispensing element includes:

providing a flexible substrate that is impervious to said volatile material;

providing an absorbent layer disposed on said substrate that retains said volatile material; and providing a protective layer that limits exposure of said absorbent material to a surrounding environment.

* * * * *